United States Patent [19]

Williams, Jr.

[11] 4,146,404

[45] Mar. 27, 1979

[54] HEATED PARTS CLEANING TANK

[76] Inventor: Samuel R. H. Williams, Jr., P.O. Box 171, Wilson, N.C. 27893

[21] Appl. No.: 871,965

[22] Filed: Jan. 24, 1978

[51] Int. Cl.[2] ..... B08B 3/10

[52] U.S. Cl. ..... 134/94; 134/110; 134/135

[58] Field of Search ..... 134/94, 102, 105, 110–111, 134/135

[56] References Cited

U.S. PATENT DOCUMENTS

| | | | |
|---|---|---|---|
| 1,783,194 | 12/1930 | McConnell et al. | 134/94 |
| 2,675,012 | 4/1954 | Scales | 134/135 X |
| 3,604,437 | 9/1971 | Tappan, Jr. | 134/102 |
| 3,896,829 | 7/1975 | Sabatka | 134/135 X |
| 4,080,975 | 3/1978 | Williams, Jr. | 134/94 |

*Primary Examiner*—Robert L. Bleutge

*Attorney, Agent, or Firm*—Clarence A. O'Brien; Harvey B. Jacobson

[57] ABSTRACT

An upwardly opening tank including peripherally extending upstanding side walls interconnected at their lower marginal portions by a bottom wall extending and secured therebetween is provided. The tank may have a cleaning liquid disposed therein to a predetermined level and includes heater structure in a lower portion thereof below the aforementioned level. A foraminous horizontal baffle is supported within the tank closely below the heater and a multi-branched tubular air manifold is supported horizontally in the tank above the baffle and below the liquid level. The manifold includes upwardly opening air outlets therein and includes an inlet for connection with a supply of air under pressure. An upwardly opening receptacle including a foraminated bottom wall is removably supported in the tank with the bottom wall of the receptacle spaced below the liquid level and above the manifold and the receptacle and tank include coacting structure whereby the receptacle may be guidingly elevated upwardly from within the tank, slightly rearwardly displaced and thereafter lowered into supported position for drainage of cleaning liquid from parts therein. The upper periphery of the tank includes an outwardly projecting peripheral drainage lip from which cleaning liquid may drain back into the tank.

10 Claims, 5 Drawing Figures

20'
20"
70
16'
16'
100
74
102
100
14'
82
14"
80
84
104
100
89
96
28
86
102
88
78
104
76
3
3
100
72
100
18'
18"

30

114
32
58
58
114
112
56
110
110
56
44
46
50
16
52
112
110
60
54
70
64
99
98
74
98
98
86
90
94
99'
96
24
26
22
92
89
38
34
28
36
36
40

HEATED PARTS CLEANING TANK

BACKGROUND OF THE INVENTION

Various forms of parts cleaning tanks containing cleaning fluid have heretofore been provided. Some of these tanks include heating elements for heating the cleaning fluid and other prior tanks include structure for discharging air upwardly through the cleaning liquid within the tank. One such tank comprises the tank disclosed in my copending U.S. application Ser. No. 748,817, filed Dec. 9, 1976, now U.S. Pat. No. 4,080,975.

In addition, other prior U.S. Pat. Nos. 1,783,194, 3,291,025 and 3,613,700 as well as Swiss Pat. No. 454,525 disclose additional similar structures.

BRIEF DESCRIPTION OF THE INVENTION

The parts cleaning tank of the instant invention includes structure for removably supporting an upwardly opening receptacle provided with a foraminated bottom within the tank at an elevation such that the bottom of the receptacle is disposed below the level of cleaning liquid in the tank. The tank further includes a heater disposed between the predetermined liquid level and an air manifold is supported within the tank above the heater and below the position of the receptacle when the latter is disposed within the tank. The manifold is operative to discharge jets of air upwardly through the cleaning liquid disposed in the tank and the lower end of the tank is provided with a sump portion from which cleaning liquid may be drained. Also, the tank includes structure coacting with companion structure on the receptacle for supporting the receptacle in an elevated position above the liquid level in the tank and in position for cleaning liquid to drain from cleaned parts disposed within the receptacle back into the tank. In addition, the upper periphery of the tank is provided with an outwardly directed drainage lip for facilitating the drainage of cleaning liquid back into the tank and a reinforced expanded metal baffle is supported within the bottom portion of the tank above the heater and below the air manifold.

The main object of this invention is to provide a parts cleaning tank which will be operative to maintain the cleaning liquid within the tank in a heated condition and which will also be operative to cause a plurality of jets of air to be directed upwardly through the tank.

Another important object of this invention is to provide a foraminated bottom parts receptacle for positioning within the tank below the liquid level therein and including structure coacting with companion structure supported from the tank whereby the parts receptacle may be conveniently supported in elevated position in substantial vertical registry with the upper end of the tank whereby cleaning liquid may drain from the parts within the receptacle back into the tank.

Another object of this invention is to provide a cleaning tank in accordance with the preceding objects and including a lower sump portion spaced below a horizontal foraminated baffle within the tank whereby the horizontal baffle may function to substantially fully isolate the cleaning liquid within the sump below the baffle against agitation and thereby enhance the precipitation of dirt particles from the cleaning liquid disposed below the baffle.

A further object of this invention is to provide a parts cleaning tank which may be readily utilized by inexperienced persons.

A final object of this invention to be specifically enumerated herein is to provide a parts cleaning tank in accordance with the preceding objects and which will conform to conventional forms of manufacture, be of simple construction and easy to use so as to provide a device that will be economically feasible, long lasting and relatively trouble-free in operation.

These together with other objects and advantage which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
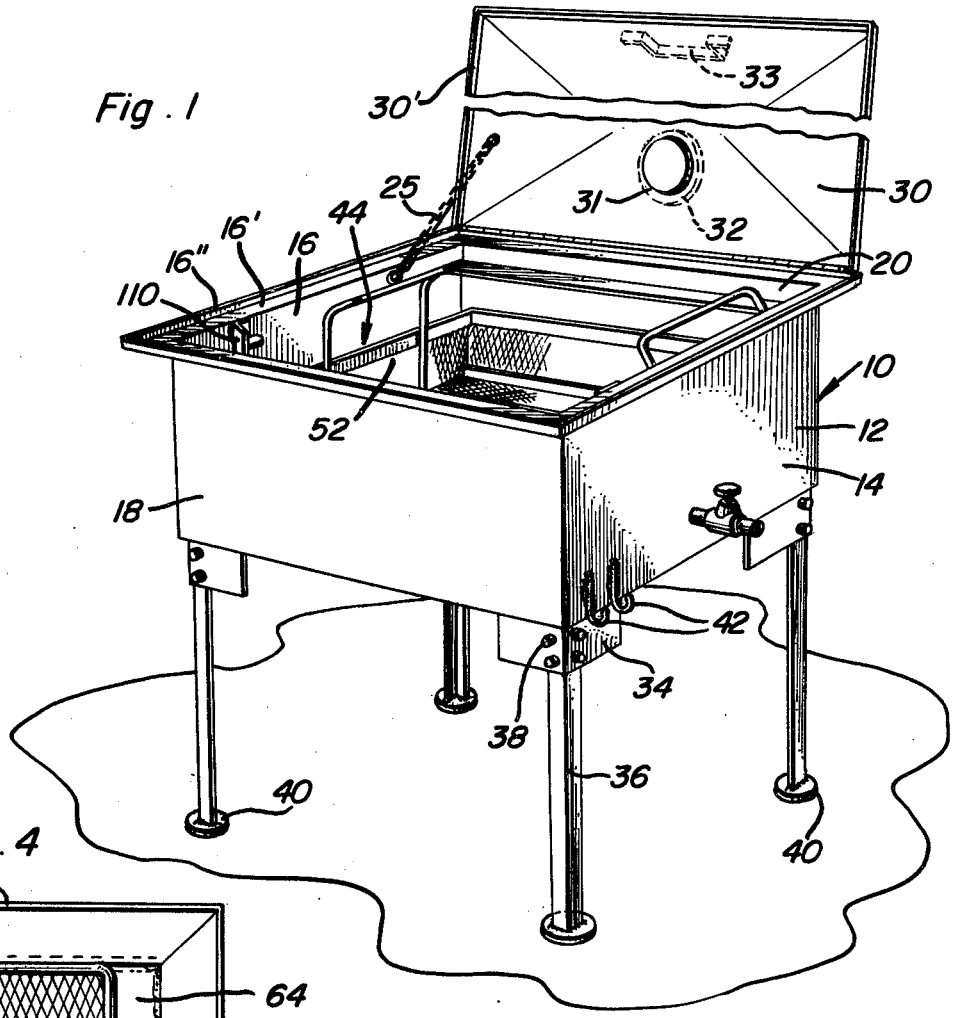
FIG. 1 is a perspective view of the parts cleaning tank of the instant invention with the top thereof illustrated in an open position, parts of the top being broken away and with the parts receptacle positioned in a lowered position within the tank.
Figure 4:
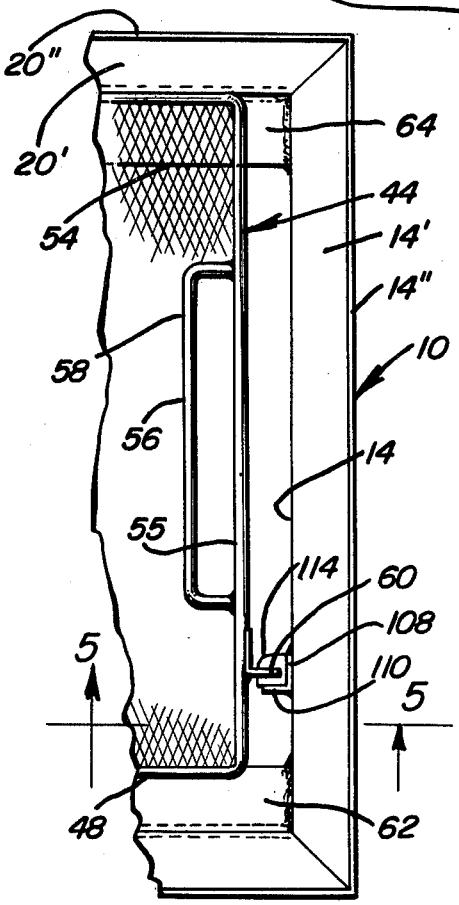
FIG. 4 is a fragmentary top plan view of the left hand of the tank illustrating the manner in which coacting companion components supported from the parts receptacle and the end walls of the tank may be utilized to support the parts receptacle within an upper portion of the tank for drainage of cleaning liquid from parts within the receptacle; and, FIG. 5 is a fragmentary vertical sectional view taken substantially upon the plane indicated by the section line 5—5 of FIG. 4.
Figure 5:
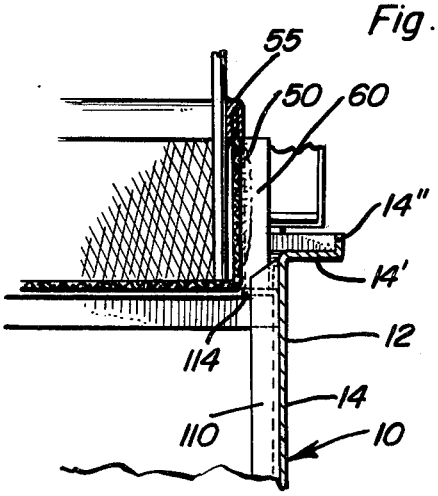

Referring now more specifically to the drawings, the numeral 10 generally designates the parts cleaning tank of the instant invention. The tank 10 includes an upper tank portion 12 having opposite end walls 14 and 16 interconnected by means of front and rear walls 18 and 20. The lower marginal portions of the walls 14, 16, 18 and 20 are interconnected by means of a bottom wall 22 extending and connected therebetween. The bottom wall 22 defines a sump 24 downwardly toward which the surrounding portions of the bottom wall 22 are inclined and the sump 24 includes a drain outlet 26 with which a valved drain line 28 is operatively associated for draining liquid from within the tank portion 12. The upper marginal portions of the walls 14, 16, 18 and 20 include horizontally outwardly directed horizontal flanges 14', 16', 18' and 20' terminating upwardly in upturned flanges 14", 16", 18" and 20". The flange 20" has the rear marginal portion of a top or cover panel 30 hingedly supported therefrom by means of a hinge assembly 32 spaced along the flange 20" and the cover panel 30 may be swung from the rearwardly and upwardly inclined open position thereof illustrated in FIG. 1 to a closed horizontal position closely overlying the flange 14', 16', 18' and 20' and with the downturned peripheral skirt 30' of the top or cover panel 30 received within the plan area bounded by the flanges 14", 16", 18" and 20". A limit chain 25 is connected between the panel 30 and the wall 16 in order to limit swinging movement of the panel 30 to the open position thereof. Further, the cover panel 30 includes an outlet vent opening 31 which may be removably covered by means of a removable closure 32 and the upper surface of the forward marginal portion of the cover panel 30 includes an upwardly projecting handle 33.

Each of the four corner portions of the tank portion 12 includes a depending angle brace 34 from which the upper end of a depending support leg 36 is removably supported by means of fasteners 38. Each of the legs 36 comprises an angle member and is provided with a disc-shaped foot 40 at its lower end. In addition, the end wall 14 of the tank 10 includes outwardly projecting and upwardly opening hooks 42 whereby a pair of gloves and a wire brush may be conveniently supported for ready use by a person desiring to use the parts cleaning tank 10.

An upwardly opening receptacle is generally referred to by the reference numeral 44 and includes foraminated opposite side walls 46 and 48 interconnected at corresponding ends by means of foraminated end walls 50 and 52 and the lower marginal portions of the walls 46, 48, 50 and 52 are interconnected by means of a foraminated bottom wall 54 extending therebetween. The upper marginal portions of the walls 46, 48, 50 and 52 are reinforced by means of a double thickness peripheral bead 55 extending about the upper portion of the receptacle 44 and the end walls 50 and 52 include inverted U-shaped handles 56 secured to the inner surfaces thereof and to the peripheral bead 55. The upper ends of the handles 56 are inwardly and upwardly inclined as at 58 and the forward marginal portions of the end walls 50 and 52 include outstanding guide and abutment flanges 60 secured thereto and projecting outwardly therefrom. Further, the interior of the tank includes hoirzontally inwardly projecting abutment flanges 62 and 64 secured to and extending along lower marginal portions of the front and rear walls 18 and 20. The flanges 62 and 64 are horizontally disposed and project inwardly from the walls 18 and 20 and also extend between and are secured to corresponding front and rear marginal portions of the end walls 14 and 16.

The receptacle 44 may be supported within the portion 12 of the tank 10 from the flanges 62 and 64 in a manner which is believed to be obvious from FIGS. 2 and 3 of the drawings and with the bottom wall 54 of the receptacle 44 spaced only slightly above an air manifold 70 and below the level of cleaning liquid within the portion 12 of the tank 10. The manifold 70 includes opposite side peripheral portions 72 and 74 interconnected at corresponding ends by means of opposite end peripheral portions 76 and 78 and the adjacent ends of the portions 72, 74, 76 and 78 are communicated with each other and a plurality of tubular transverse portions 80, 82 and 84 extend between corresponding portions of the peripheral portions 72 and 74 and are communicated with the interiors thereof. Accordingly, the manifold 70 defines a hollow multi-branched air chamber.

A valved air supply line 86 passes through the lower portion of the end wall 14 in fluid tight sealed engagement therewith and the end peripheral portion 76 of the manifold 70 includes a central air inlet neck 88 removably coupled to the discharge end of the air line 86 by means of a pipe union 89. Of course, the inlet end of the line 86 is adapted to be communicated with a suitable source of air under pressure.

The interior of the lower portion of the tank portion 12 includes a horizontal foraminated baffle 90 including downturned opposite side and end peripheral flanges 92 and 94 whose lower marginal edges are abutted against and supported from the corresponding marginal portions of the bottom wall 22. The baffle 90 may be constructed of expanded metal as may be the walls 46, 48, 50 and 52 of the receptacle 44 and an electrical heating element 96 is disposed within the lower portion of the tank portion 12 below the baffle 90.

The foraminated baffle 90 includes inverted V-shaped transverse reinforcing angle members 98 secured thereto at points spaced therealong and the manifold 70 is stiff but somewhat resilient and is, at least in those portions thereof spaced toward the peripheral portion 78 from the transverse portion 80, yieldingly biased downwardly upon the opposing angle member 98.

The electrical resistance heating element 96 is secured through the end wall 16 of the portion 12 of the tank 10 in sealed engagement therewith and an electrical terminal block 99 is electrically connected to the exterior portion of the heating element 96 and is enclosed within a downwardly opening shroud 99' secured to and supported from the exterior of the end wall 16 of the portion 12 of the tank 10.

Figure 2:
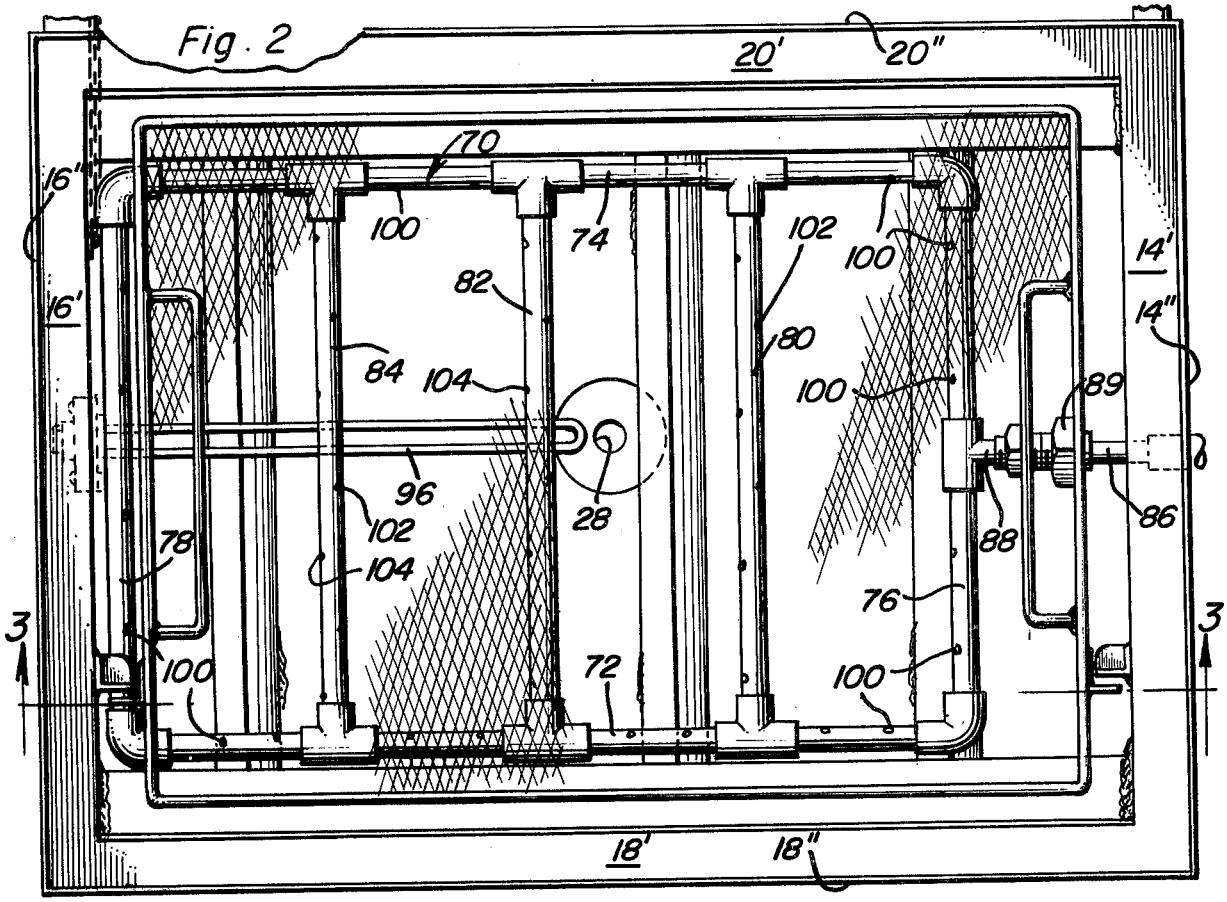
FIG. 2 is an enlarged top plan view of the tank.
Figure 3:
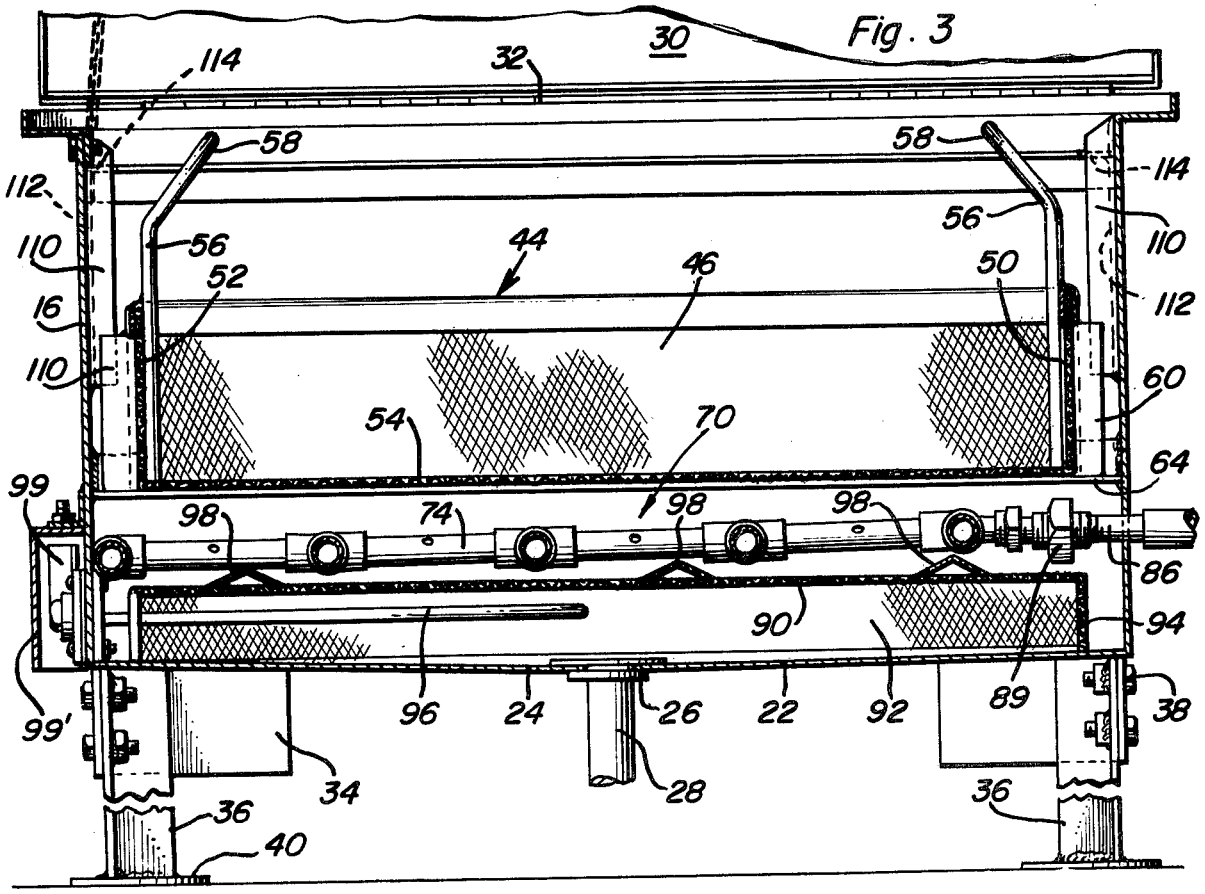
FIG. 3 is a longitudinal vertical sectional view taken substantially upon the plane indicated by the section line 3—3 of FIG. 2 and with portions of the legs of the tank broken away.

With attention now invited more specifically to FIG. 2 of the drawings, it may be seen that each of the portions 72, 74, 76 and 78 of the manifold 70 includes longitudinally spaced openings 100 formed therein which open upwardly in inwardly inclined directions. In addition, the portions 80, 82 and 84 include openings 102 and 104 formed therein at points spaced alternately therealong and which open upwardly in oppositely inclined directions. Accordingly, when air is supplied under pressure to the manifold 70, jets of air are discharged from the openings 100, 102 and 104 whereby upward jets of compressed air are discharged into the cleaning liquid for agitating the latter and assisting in cleaning of any parts contained within the receptacle 44. The upwardly and inwardly inclined openings 100 insure that the return flow of liquid down into the bottom of the tank is downwardly along the inner surfaces of the walls 14, 16, 18 and 20 whereby the returning liquid may pass downwardly through the baffle 90 and pass toward the center of the bottom wall 22 of the tank portion 12 in a non-agitated state to thereby enable the dirt entrained therein to be precipitated therefrom down onto the bottom 22 prior to the liquid being gradually moved upwardly through the baffle 90 as a result of air being discharged upwardly from the manifold 70. The heater 96 is of the thermostatically controlled type and, therefore, may maintain the temperature of the liquid within the tank portion 12 substantially constant.

The top cover or panel 30 of the tank portion 12 may be swung to a closed position with or without the receptacle 44 supported within the tank portion 12.

In addition to the outstanding flanges 60 carried by the forward marginal portions of the end walls 50 and 52 of the receptacle 44, the forward marginal portions of the end walls 12 and 16 of the portion 12 of the tank 10 have angle brackets 108 secured to the inner surfaces thereof, the angle brackets 108 including forward inwardly directed upstanding guide flanges 110. The inner surfaces of the portions of the brackets 108 secured to the inner surfaces of the end walls 14 and 16 have upstanding strap members 112 secured thereto and the upper ends of the strap members are horizontally inwardly directed as at 114 and define abutment flanges adjacent but spaced below the upper ends of the brackets 108. When the receptacle 44 is lowered down into position within the tank, the flanges 60 are disposed forwardly of the flanges 110 and thus the flanges 60 and 110 serve to guide the upward movement of the receptacle 44 from within the portion 12 of the tank 10. After the flanges 60 have been elevated above the flanges 110, the receptacle 44 may be slightly rearwardly displaced so that its rear marginal portion overlies an upper rear abutment flange 113 (corresponding to the flange 64) and the flanges 60 are disposed rearwardly of a vertical plane containing the flanges 110. Then, the receptacle 44 may be slightly lowered into position with the rear marginal portions thereof supported from the flange 113 and the lower ends of the flanges 60 supported from the abutment flanges 114. In this position, the receptacle 44 is supported within the top portion of the tank and in a manner such that all cleaning liquid draining from parts within the receptacle 44 will drain therefrom downwardly into the portion 12 of the tank 10.

In operation, parts to be cleaned may be placed within the receptacle 44 and the latter may then be lowered downwardly into the partion 12 of the tank 10 with the flanges 60 disposed forwardly of a vertical plane containing the flanges 110 for support of the receptacle 44 in a lowered position within the portion 12 of the tank 10 from the flanges 62 and 64. Then the liquid within the tank portion 12 may be heated by means of the heater 96 and the remote source of air under pressure may be communicated with the pipe 86. Of course, when air under pressure is supplied to the manifold 70, air under pressure will be discharged from the openings 100, 102 and 104 and cause agitation of the cleaning liquid within the tank portion 12 above the manifold 70 and thus within the receptacle 44, the upper surface of the liquid within the tank portion 12 being elevated considerably as a result of air being entrained within the liquid during the process of being bubbled upwardly through the liquid.

After the parts within the receptacle 44 have been cleaned, the supply of air under pressure to the manifold 70 may be terminated and the handles 56 may be grasped to raise the receptacle upwardly until the flanges 60 are elevated above the flanges 110. Then, the receptacle 44 is slightly rearwardly displaced until the flanges 60 have passed rearwardly through the vertical plane containing the flanges 110. Thereafter, the receptacle 44 may be slightly lowered into supported position within the upper portion of the tank with the rear marginal portion of the receptacle 44 supported from the flange 113 and the forward portion of the receptacle 44 supported by abutting engagement of the lower ends of the flanges 60 with the upper surfaces of the flanges 114. The cleaning liquid remaining on the cleaned parts may then drain therefrom back into the upper portion 12 of the tank 10.

When it becomes necessary to clean the residue of dirt from the bottom of the tank portion 12, the cleaning liquid within the tank portion 12 may be drained therefrom through the outlet 26. In addition, the manifold 70 may be readily removed by uncoupling the union 89 and after the manifold 70 has been removed, the baffle 90 may also be readily removed. This, of course, provides free access to the upper surface of the bottom wall 22 of the portion 12 of the tank 10 for cleaning purposes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, an upwardly opening tank including peripherally extending upstanding front and rear walls and opposite end walls interconnected at their lower marginal portions by means of a bottom wall extending and secured therebetween, said tank being adapted to have a cleaning liquid disposed therein to a predetermined level, heater means in a lower portion of said tank below said level operative to heat said liquid, a multi-branched tubular air manifold disposed horizontally in said tank spaced above said bottom wall and below said level, said manifold including means defining jet-type air outlet openings therefor spaced along the multiple branches of said manifold and operative to discharge jets of air upwardly into the liquid disposed in said tank in response to the interior of said manifold being communicated with a source of air under pressure, an upwardly opening receptacle including foraminated bottom wall portions, said receptacle and tank including means for supporting said receptacle within a lower portion of said tank above said manifold and with said receptacle at least projecting below said level, the upper marginal edges of said walls including peripherally continuous outwardly projecting flange means terminating outwardly in peripherally continuous upwardly projecting flange means, said receptacle including upstanding front and rear walls and opposite end walls interconnected at their lower marginal portions by means of said foraminated bottom wall portions, the forward marginal portions of said receptacle end walls including outstanding upright abutment flanges, said end walls of said tank including upstanding inwardly projecting guide flanges forwardly of which said abutment flanges are closely disposed when said receptacle is supported within said tank, said receptacle being upwardly displaceable to a position with said receptacle closely adjacent the upper marginal portions of said tank and with said abutment flanges elevated slightly above said guide flanges, and horizontal inwardly projecting tank wall abutment flanges spaced rearwardly of and closely below the upper ends of said guide flanges, said receptacle, when in said elevated position, being slightly rearwardly displaceable to pass said abutment flanges rearwardly of said guide flanges and thereafter slightly downwardly displaceable to a position with said receptacle abutment flanges abutted against and supported from said tank wall abutment flanges and with the rear marginal portion of the bottom of said receptacle spaced closely adjacent the inner surfaces of the upper marginal portion of the rear wall of said tank, and horizontally inwardly projecting abutment means carried by the upper marginal portion of said rear wall and from which the rear marginal portion of said receptacle may be supported when in said elevated position, said rear marginal portion of said receptacle being spaced forwardly of said abutment means when said abutment flanges are disposed forwardly of said guide flanges.

2. The combination of claim 1 including a foraminous horizontal baffle disposed in said tank below said level and above said bottom wall and above which said manifold is disposed.

3. The combination of claim 2 wherein said baffle comprises an expanded sheet metal member and includes front to rear extending longitudinally spaced reinforcing members overlying and secured thereto, at least portions of said manifold being abutted against and supported from said reinforcing members.

4. The combination of claim 1 wherein said means for supporting said receptacle within said tank includes front and rear inwardly projecting and upwardly facing abutment structures supported from lower marginal portions of the front and rear walls of said tank, the front and rear marginal portions of the bottom wall portions of said receptacle being engageable with said abutment structures for support therefrom.

5. The combination of claim 4 wherein said abutment structures include horizontal flange members extending the full length along and secured to said front and rear walls of said tank and whose opposite ends are also secured to the inner sides of the opposite end walls of said tank.

6. The combination of claim 1 including a cover panel for said tank including a rear marginal edge portion hingedly supported from the upright abutment flange means supported from the rear wall of said tank and swingable between a horizontal position overlying the upper end of said tank and an upright position projecting upwardly from the rear wall of said tank.

7. The combination of claim 6 wherein said cover panel includes a peripherally extending depending skirt, said depending skirt being received within the plan area bounded by said upwardly projecting flange means when said cover panel is in a closed position.

8. The combination of claim 7 including a foraminous horizontal baffle disposed in the tank below said level and above said bottom wall and above which said manifold is disposed.

9. The combination of claim 8 wherein said baffle comprises an expanded sheet metal member and includes front to rear extending longitudinally spaced reinforcing members overlying and secured thereto, at least portions of said manifold being abutted against and supported from said reinforcing members.

10. In combination, an upwardly opening tank including peripherally extending upstanding front and rear walls and opposite end walls interconnected at their lower marginal portions by means of a bottom wall extending and secured therebetween, said tank being adapted to have a cleaning liquid disposed therein to a predetermined level, heater means in the lower portion of said tank below said level operative to heat said liquid, a multibranched tubular air manifold disposed horizontally in said tank spaced above said bottom wall and below said level, said manifold including means defining jet-type air outlet openings therefor spaced along the multiple branches of said manifold and operative to discharge jets of air upwardly into the liquid disposed in said tank in response to the interior of said manifold being communicated with a source of air under pressure, an upwardly opening receptacle including foraminated bottom wall portions, said receptacle and tank including means for supporting said receptacle within a lower portion of said tank above said manifold and with said receptacle at least projecting below said level, said receptacle including upstanding front and rear walls and opposite end walls interconnected at their lower marginal portions by means of said foraminated bottom wall portions, the forward marginal portions of said receptacle end walls including outstanding upright abutment flanges, said end walls of said tank including upstanding inwardly projecting guide flanges forwardly of which said abutment flanges are closely disposed when said receptacle is supported within said tank, said receptacle being upwardly displaceable to a position with said receptacle closely adjacent the upper marginal portions of said tank and with said abutment flanges elevated slightly above said guide flanges, and horizontal inwardly projecting tank wall abutment flanges spaced rearwardly of and closely below the upper ends of said guide flanges, said receptacle, when in said elevated position, being slightly rearwardly displaceable to pass said abutment flanges rearwardly of said guide flanges and thereafter slightly downwardly displaceable to a position with said receptacle abutment flanges abutted against and supported from said tank wall abutment flanges and with the rear marginal portion of the bottom of said receptacle spaced closely adjacent the inner surfaces of the upper marginal portion of the rear wall of said tank, and horizontally inwardly projecting abutment means carried by the upper marginal portion of said rear wall and from which the rear marginal portion of said receptacle may be supported when in said elevated position, said rear marginal portion of said receptacle being spaced forwardly of said abutment means when said abutment flanges are disposed fowardly of said guide flanges.

* * * * *